US008141319B2

(12) United States Patent
Brady

(10) Patent No.: US 8,141,319 B2
(45) **Date of Patent: *Mar. 27, 2012**

(54) BACK PLATE BRACKETING SYSTEM

(75) Inventor: Todd A. Brady, Beverly Hills, CA (US)

(73) Assignee: Brady Innovations, LLC, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/706,810

(22) Filed: Feb. 17, 2010

(65) Prior Publication Data

US 2010/0139203 A1 Jun. 10, 2010

Related U.S. Application Data

(63) Continuation of application No. 12/041,424, filed on Mar. 3, 2008, now Pat. No. 7,739,852.

(51) Int. Cl.
*E04C 2/34* (2006.01)
*E04C 3/30* (2006.01)
*E04C 5/01* (2006.01)

(52) U.S. Cl. ..... 52/655.1; 52/481.1; 52/317; 52/653.1; 52/713

(58) Field of Classification Search ..... 52/317, 52/349, 243, 481.1, 657, 693, 696, 655.1, 52/653.1, 713; 248/218, 222.52, 300; 403/230, 403/403; 156/71, 91, 247, 344
See application file for complete search history.

(56) References Cited

U.S. PATENT DOCUMENTS

| | | | | | |
|---|---|---|---|---|---|
| 3,562,973 | A * | 2/1971 | Gangemi | 52/71 |
| RE28,672 | E * | 1/1976 | Wakeman | 16/227 |
| 4,109,434 | A * | 8/1978 | Katzin | 52/288.1 |
| 4,979,611 | A * | 12/1990 | Bolliger et al. | 206/83 |
| 5,685,662 | A * | 11/1997 | Rollin et al. | 403/231 |
| 5,756,174 | A * | 5/1998 | Tuneberg | 428/40.1 |
| 6,023,898 | A * | 2/2000 | Josey | 52/309.5 |
| 7,331,149 | B2 * | 2/2008 | Tollenaar | 52/481.1 |
| 7,753,220 | B2 * | 7/2010 | Konstant | 211/191 |
| 2003/0033771 | A1 * | 2/2003 | Anderson | 52/288.1 |
| 2003/0049078 | A1 * | 3/2003 | Snyder | 405/212 |
| 2007/0201946 | A1 * | 8/2007 | Sammann | 403/403 |
| 2007/0234661 | A1 * | 10/2007 | Vaes | 52/287.1 |

* cited by examiner

*Primary Examiner* — Robert Canfield
*Assistant Examiner* — Christine T Cajilig
(74) *Attorney, Agent, or Firm* — Trojan Law Offices

(57) ABSTRACT

A bracketing system is provided having two brackets joined by a flexible adhesive material that allows bridging or backing members of variable lengths and widths to be mounted between vertical studs to enhance stability of the wall construction. A wall construction assembly according to an embodiment of the invention comprises two vertical studs and a bridge backing member mounted there between by a bracketing system, which includes a left bracket and a right bracket connected by a flexible adhesive material. Because the bridge backing member can be adjustably sized to be secured on the brackets, it can be sized to fit between studs regardless of any variation in the spacing of the studs. This obviates the need to prefabricate bridge backing members to fit between variably spaced studs. The bridge backing member can be mounted flush with the stud to eliminate unevenness in the wall structure. Bridge or backing members of various widths and lengths can be mounted to the bracketing system.

3 Claims, 5 Drawing Sheets

BACK PLATE BRACKETING SYSTEM

STATEMENT OF PRIORITY

This is a continuation application of Ser. No. 12/041,424, filed Mar. 3, 2008 now U.S. Pat. No. 7,739,852.

BACKGROUND OF THE INVENTION

1. Field of the Invention

This invention relates to a wall construction assembly and, more particularly, to a bracketing system for assembling horizontal members to vertical studs.

2. Background Information

In a conventional wall frame assembly, a wall is constructed from a combination of horizontal members (or otherwise known as backing plates) affixed to vertical studs to form a frame structure onto which drywall or other types of wallboards are attached. Horizontal members and vertical studs are typically of a C-channel or U-channel flat strap stock variety, having a web connecting two flanges. Horizontal members can function as backing support by being installed transversely between vertical studs to provide enhanced lateral and vertical stability for the wall. Horizontal members can also function as reinforced backing to support heavy loads, such as from the mounting of heavy equipment on the wall to provide backing to anchor equipment. For example, when large medical equipment sinks are wall mounted in a hospital, a backing plate of sufficient load capacity is required to support it. Like bridging members, such backing plates are mounted transversely between vertical studs to provide enhanced stability to support dead loads and pull out loads.

Prior to the present invention, a horizontal member (referred herein alternately as bridging, backing or bridge backing member) would be affixed directly to the vertical studs, generally by means of attachment screws and/or weld. The horizontal member must be welded to account for poor design and construction tolerances. The direct assembly of horizontal members to vertical studs presented a number of problems.

First, though wall studs are typically installed at set intervals (e.g. 16 inch on center spacing), often there is variation in the spacing. Because of the variable spacing between studs, it is difficult to prefabricate (stock) bridge backing members to universally fit between the studs. Bridge backing members are manufactured in oversized stock lengths that must usually be cut to fit at the job site. The time and labor required to cut bridge backing members to custom fit the particular application greatly increase construction costs.

One attempt to overcome the problem of fitting a bridging or backing member between variably spaced studs is disclosed in U.S. Pat. No. 4,717,101 to Harrod, which teaches an adjustable backing board. The invention disclosed by Harrod is comprised of two interfitted rectangular channel pieces, telescoped together, with one piece being slideably mounted within the larger channel such as to be adjustable therein. Similarly, U.S. Pat. No. 4,658,556 to Jenkins teaches a system of expandable and retractable backing spans for fitting between studs. Both patents are directed to adjustable backing members, rather than to a bracketing system for mounting standardized backing members, and both require complex engineering to make the backing members adjustable.

A second problem with attaching bridge backing members directly on vertical studs is that, because the backing members are cut from stock channels, the backing members have no end surfaces that can be fastened to the vertical studs. As a consequence, in order to attach a bridge backing member between two studs, it is generally necessary to cut the ends of the flanges on the backing member so that the web of the bridge backing member can be fastened over the vertical studs. That is, the flanges must be cut to fit between the studs, such as to leave corresponding sections of the web on either end to overlap with the sides of the vertical studs. For example, n U.S. Pat. No. 1,867,449, Ecket et al. teaches a bridging member for positioning between studs variably spaced apart, in which the ends of the bridging member must be cut inwardly to provide a securing plate for attaching to the studs. The drawback of having to custom cut each bridge backing member in this way to fit between the studs is the increase in construction time and cost.

A third problem with the direct assembly of bridge backing members to vertical studs is that it often resulted in cosmetic problems because it created bulges in the wallboard, which required additional labor and material to correct by finishing over the uneven surface of the wall. The problem resulted from the fact that when the backing member is mounted directly on the studs, the web of the backing member sits over the side flanges of the studs which, plus the buildup of the screw, created an uneven surface. In order to eliminate this problem of an uneven surface resulting from the direct attachment of the screw on the stud surface, a backing member would have to be mounted flush with the sides of the vertical studs.

U.S. Pat. No. 5,189,857 to Herren et al. teaches a flush mount bridging and backing plate having a traverse end plate at one end of the channel and a Z-shaped tongue at the opposite end of the channel. The tongue fits between the two flanges of a stud, thereby allowing the backing plate to be mounted flush with the sides of the stud. The end plate and tongue provide end tabs so that the backing plate can be mounted directly onto the studs' web without having to cut the flanges on the backing plate as described above. However, one major disadvantage of backing plates having prefabricated end tabs is that it is still required to mount directly to the studs without the ability to adjust to uneven stud layout. Because of the variable spacing between studs, stock backing members having prefabricated end tabs do not always fit between studs that are variably spaced apart. If in a particular application the studs are too wide or too narrow apart, such stock backing plates having prefabricated end tabs do not fit. Furthermore, it is more costly to manufacture backing plates with Z-shaped end tabs that are not adjustable.

In sum, the standard practice in the art is to mount backing members directly onto and over studs, which results in the disadvantages described above. For the foregoing reasons, there is a need for a bracketing system that can mount horizontal bridge backing members with vertical studs. There is a need for a cost-effective installation method for a bracketing system that can mount stock bridging or backing members between variably spaced studs without the need to cut each individual member to fit between the studs. There is a need for a bracketing system that can mount bridge backing members without having to cut the flanges of the members to create end tabs for mounting on the studs. There is a need for a bracketing system that can allow for a bridge backing member to mount flush with the stud, so as to eliminate cosmetic unevenness in the wall structure. The claimed invention avoids the above problems and provides significant savings in material and labor costs (e.g. scrap (leftover) materials can be used as bridge backing between studs and on said bracketing system).

SUMMARY OF THE INVENTION

The present invention is directed to a bracketing system that allows for adjustably connecting building components in a building construction.

It is a purpose of the present invention is to provide a bracketing system for adaptable on-site installation of bridging or backing members between variably spaced vertical studs. This bracketing system comprises two brackets held together by an adjustable adhesive material. The bracketing system can be mounted onto the vertical studs of a wall construction for supporting a bridging or backing member there between.

It is a purpose of the present invention is to provide an efficient method of indirectly mounting bridging or backing members between vertical studs that will eliminate the need for attaching the bridging or backing members directly on the vertical studs.

It is another purpose of the present invention to provide a bracketing system that will reduce the time, labor, and material required for mounting bridging or backing members by eliminating the need to cut each (pre-fabricated or stock) member to fit between variably spaced studs.

Another purpose of the present invention is to provide a bracketing system that will reduce the time, labor, and material required for mounting bridging or backing members by eliminating the need to cut each member to create end tabs for attaching directly on the vertical studs.

Still a further purpose of the present invention is to provide an efficient method of mounting bridging or backing members with vertical studs that will enhance the structural stability of the wall frame construction and mounting equipment thereto.

Still a further purpose of the present invention is to provide a bracketing system that can accommodate bridging or backing members of various widths and lengths.

The present invention introduces such refinements. In a preferred embodiment of the invention, the bracketing system comprises a left bracket and a right bracket joined by an adhesive material. The designation "left" and "right" is for ease of reference only and is not intended to limit the orientation of the brackets. The left bracket has a reverse L-shape, with a first left plate joined at a right angle to a second left plate. Mirroring the left bracket, the right bracket has an elongated L-shape, with a first right plate joined perpendicularly at right angle to an elongated second right plate. In an embodiment of the invention, the second right plate is formed with a groove that runs along its length parallel to the first right plate. The groove divides the second right plate of the right bracket substantially into two halves.

The left bracket is joined to the right bracket by a removable adhesive adjustable tap. The removable adhesive attaches to the respective second left plate and second right plate of the two brackets, such that the two second plates are substantially co-planar with each other.

To mount a bridge backing member to a vertical stud, the bracketing system is first installed on the stud. In a preferred method of installing the bracketing system, the left bracket is placed in a desired vertical location on the stud, with the first left plate mating to the web of the stud. The right bracket is then peeled from the adhesive, such that the exposed adhesive attaches to a flange on the stud. The right bracket is wrapped around the flange of the stud. In this configuration, the respective first left plate and first right plate of the two brackets will sandwich the web of the stud, while the respective second left plate and second right plate are substantially co-planar. One half of the second right plate of the right bracket will mate with the inside surface of the flange. The other half of the second right plate of the right bracket extends beyond the flange of the stud for mounting with a bridge backing member. The adhesive material functions to temporarily hold the two brackets in place with the stud while a screw or other attachment means is passed through the first left plate and first right plate sandwiching the stud web in order to attach the brackets to the stud.

For a vertical stud having a C-channel frame section with lips on the flanges, the bracketing system must be mounted in a manner that accommodates the lips of the flanges. When the right bracket is wrapped around the flange of the stud, the groove on the second right plate of the right bracket accommodates the lip on the flange of the stud. With the groove accommodating the lip of the flange, the first right plate mates to an inside surface of the web of the stud, sandwiching the web between the first left plate and the first right plate. One half of the second right plate of the right bracket will mate with an inside surface of the flange, with the lip of the flange accommodated by the groove on the second right plate. Again, a screw or other attachment means is used to secure the first left plate and first right plate to the stud.

Conversely, the bracketing system can be installed by first attaching the right bracket to the stud. The first plate of the right bracket mounts to the inside face of the web on the stud. When the right bracket first plate mounts to the inside web, one half of the second right plate mounts to the inside face of the flange on the stud, with the groove accommodating the lip of the flange, and the other half of the second right plate extending outward. The first left plate of the left bracket then mounts to the outside face of the web on the stud, such that the respective first plates of the two brackets sandwich the web of the stud. Metal screws or other attachment means are used to attach the respective first left plate and first right plate to the web of the stud, and screws can be used to also attach the second right plate of the right bracket to the flange of the stud.

With pairs of brackets mounted to each stud at a corresponding elevation, a bridge backing member can be mounted between the brackets. The bridge backing member can be mounted to the face of the second plates of the respective brackets such that the web of the backing member is flush with the flange of the stud. Because the backing member can be movably positioned on the brackets, the backing member (cut from stock or scrap materials) can be adjusted to fit between the studs regardless of any variation in the spacing of the studs. This obviates the need to notch the stock backing member to fit between variably spaced studs. This also obviates the need notch each stock backing member to create end tabs for mounting with the studs.

Bridge or backing members of various widths can be mounted to the bracketing system. In one embodiment of the invention, the flanges of the bridge backing member can mount over and under the respective top and bottom edges of the second left plate or second right plate. For bridge backing members having narrower (generally 3⅝, 4 or 6 inches) widths, the left and right brackets are provided with notches in the second left plate and second right plate. The flanges of the bridge backing member can be inserted into the notches of the brackets. For example, one flange of the bridge backing member can insert into corresponding notches on the second left plate and second right plate, of the respective second plates. Alternatively, flange of the bridge backing member can insert into corresponding notches on the second left plate and second right plate with the other flange mounted under the bottom edge on the second left plate and second right plate. Or both flanges of the bridge backing member can insert into notches in the second left plate or second right plate. Once the bridge backing member is mounted to the brackets, screws or other attachment means can be used to secure it to the brackets. In this way, a backing member can be mounted between sets of brackets attached to the studs.

While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

BRIEF DESCRIPTION OF THE DRAWINGS

The above and various other objects and advantages of the invention will be described and understood from the following detailed description of the preferred embodiment of the invention, the same being illustrated in the accompanying drawings.

DETAILED DESCRIPTION OF THE PREFERRED EMBODIMENT

Figure 1:
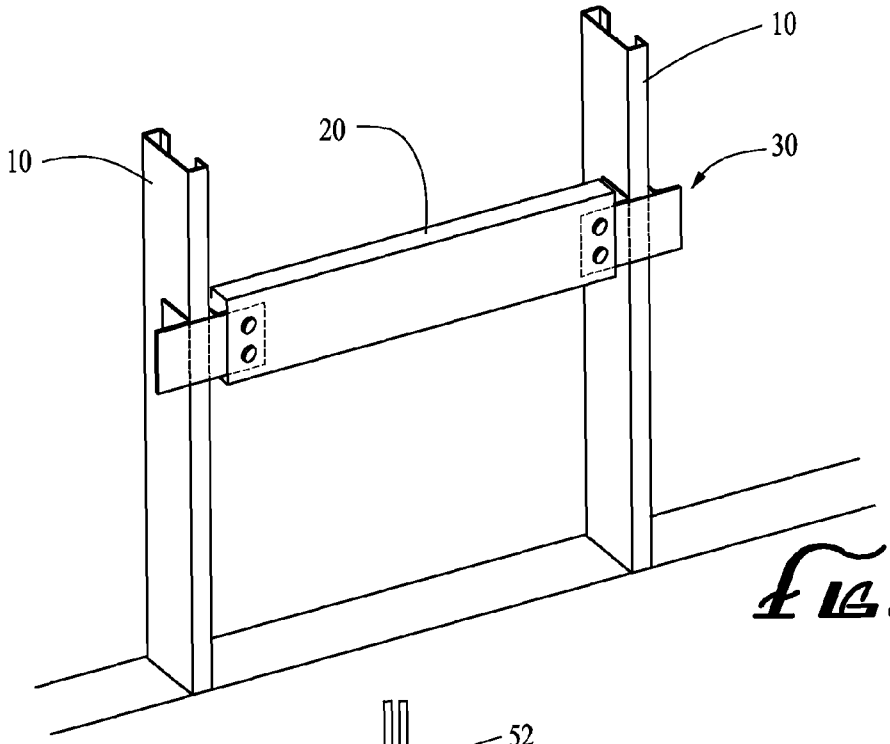
FIG. 1 is a perspective view of an embodiment of the invention.
Figure 4:
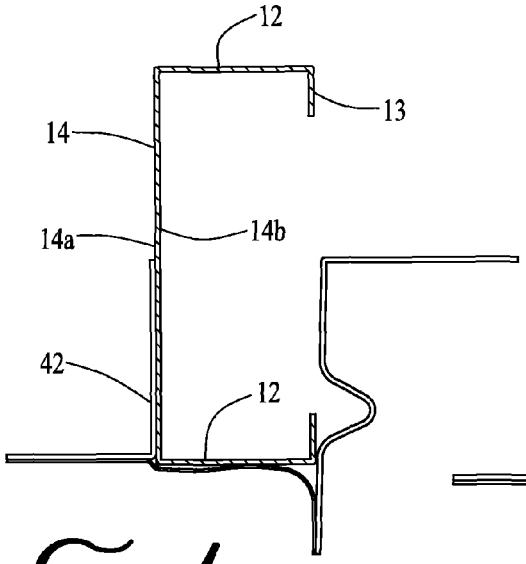
FIG. 4 is a top sectional view of a bracketing system and a vertical frame member.

A building construction assembly according to a preferred embodiment of the invention is shown in FIG. 1. Referring to FIG. 1, a bridge backing member 20 is mounted between two vertical studs 10 by bracketing systems 30. Both vertical stud 10 and bridge backing member 20 are made of common channel stock of the C-channel or U-channel variety, having in common two flanges 12 joined by a web 14 to form a channel frame. For a C-channel frame as shown in FIG. 4, each flange 12 has lip 13. It would be understood by one of ordinary skill in the art that the bracketing system 30 described herein can work for its intended purpose with either C-channel or U-channel frames.

Figure 2:
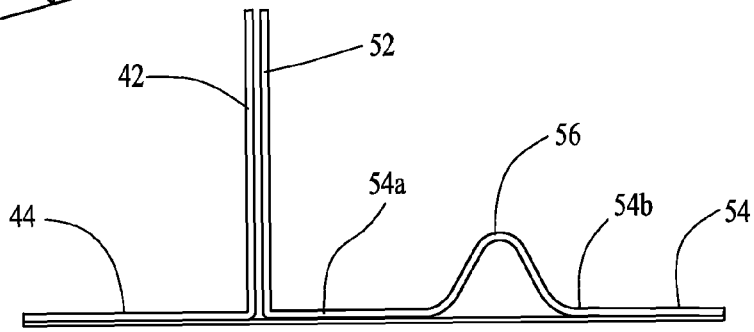
FIG. 2 is a top view of a bracketing system shown in a closed configuration.
Figure 3:
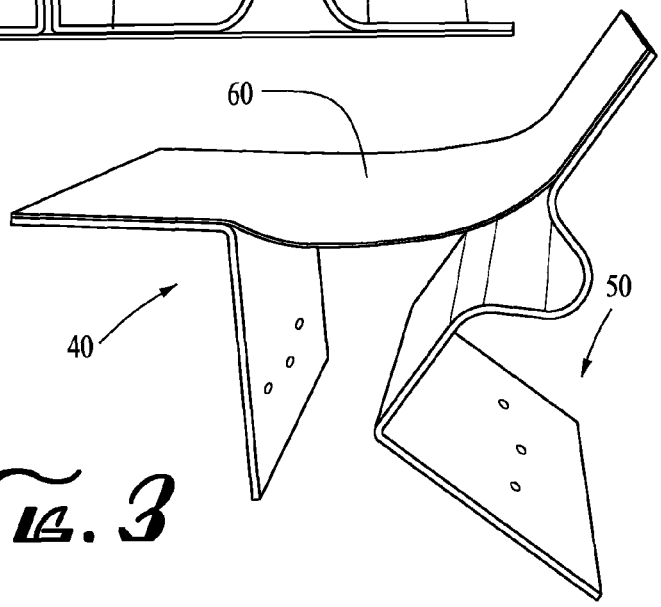
FIG. 3 is a perspective view of a bracketing system shown in an opened configuration.

FIG. 1 shows a bridge backing member 20 mounted between two bracketing systems 30. Bracketing system 30 is mounted to each of two vertical studs 10 by attachment means 70 (shown in FIG. 6). As shown more particularly in FIGS. 2 and 3, each bracketing system 30 includes a left bracket 40 and a right bracket 50 connected by adhesive material 60. The "left" and "right" designations are for ease of reference only and are not meant to limit the orientation of the respective brackets. Left bracket 40 has a first left plate 42 joined to a second left plate 44. Right bracket 50 has a first right plate 52 joined to an elongated second right plate 54. The second right plate 54 has a groove 56 therein that runs substantially along its length and parallel to first right plate 52, dividing second right plate 54 into two sections, 54*a* and 54*b*. Left bracket 40 is connected to right bracket 50 by adhesive material 60 that attaches to the sides of second left plate 44 and second right plate 54, such that second left plate 44 and second right plate 54 are substantially coplanar as shown in FIG. 2.

Figure 8:
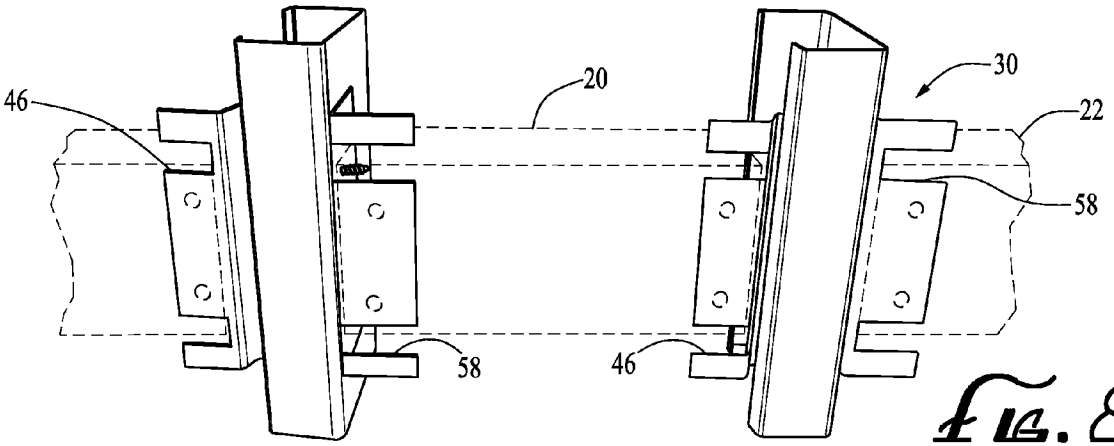
FIG. 8 is a perspective view of an embodiment of the invention, showing a narrow bridge backing member mounted to a pair of bracketing systems having notches.

In another embodiment of the invention shown in FIG. 8, the bracketing system 30 includes a left bracket 40 having at least one notch 46 in second left plate 44. Likewise, right bracket 50 also has at least one corresponding notch 58 in second right plate 54. The notches allow for bridging/backing members of varying widths to be mounted to bracketing system 30 as described more fully below.

Again referring to FIG. 1, in a preferred method for assembling the building construction, a bracketing system 30 is mounted on a first vertical stud 10. Another bracketing system 30 is mounted on a second vertical stud 10. A bridge backing member 20 is mounted between the two bracketing systems 30.

Figure 5:
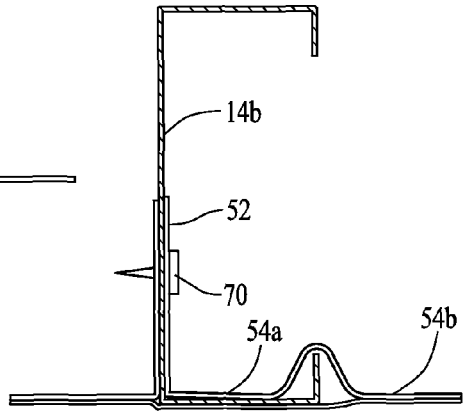
FIG. 5 is a top sectional view of the bracketing system engaged with a vertical frame member.
Figure 6:
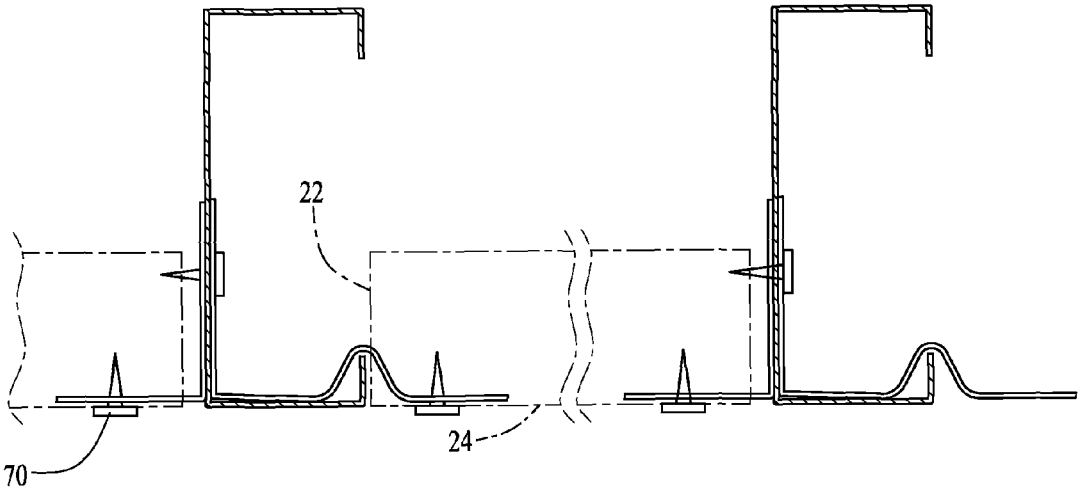
FIG. 6 is a top sectional view of an embodiment of the invention.

Referring more particularly to FIGS. 4 and 5, in order to mount bracketing system 30 on vertical stud 10, left bracket 40 is placed on vertical stud 10 with first left plate 42 mating with first surface 14*a* of web 14 of vertical stud 10. To facilitate assembly of bracketing system 30 on vertical stud 10, adhesive material 60 can be applied to a flange 12 of vertical stud 10 to hold bracketing system 30 in place while left bracket 40 and right bracket 50 are secured to vertical stud 10. The right bracket 50 is wrapped around flange 12 of vertical stud 10, such that first right plate 52 mates with second surface 14*b* of web 14 of vertical stud 10. In this configuration, first left plate 42 and first right plate 52 sandwich web 14 of vertical stud 10 and second left plate 44 is substantially coplanar with second right plate 54 as shown in FIG. 5. An attachment means 70 is passed through the first right plate 52, the web 14, and the first left plate 42 to mount bracketing system 30 to vertical stud 10 as shown in FIG. 6. Or, conversely, the attachment means can be applied in an opposite orientation.

FIGS. 4 and 5 show the assembly of bracketing system 30 onto a vertical stud 10 having a C-channel cross-section, wherein flange 12 has lip 13. For a vertical stud 10 having a C-channel cross-section, right bracket 50 is wrapped around vertical stud 10 with groove 56 accommodating lip 13 on vertical stud 10. Again, web 14 of vertical stud 10 is sandwiched between first left plate 42 and first right plate 52. First right plate 52 mates with second surface 14*b* of web 14, and section 54*a* of second right plate 54 mates with an inside surface of flange 12. Section 54*b* of second right plate 54 extends beyond lip 13 of vertical stud 10, so as to allow mounting of a bridge backing member 20 thereon as shown in FIG. 6. It should be noted that though FIGS. 4 and 5 show the mounting of bracketing system 30 to a vertical stud having a C-channel cross-section, it would be understood by one of ordinary skill in the art that the above method of mounting bracketing system 30 would work equally well with any stock channel frame, including studs having a U-channel cross-section.

Referring to FIG. 6, after bracketing system 30 is mounted to vertical stud 10, a bridge backing member 20 can be mounted to bracketing system 30. In order to mount bridge backing member 20 on bracketing system 30, the bridge backing member 20 is attached to the second left plate 44 of left bracket 40 at one end and to section 54*b* of second right plate 54 of right bracket 50 at the other end. Attachment means 70 is used to fasten bridge backing member 20 on bracketing system 30.

Figure 7:
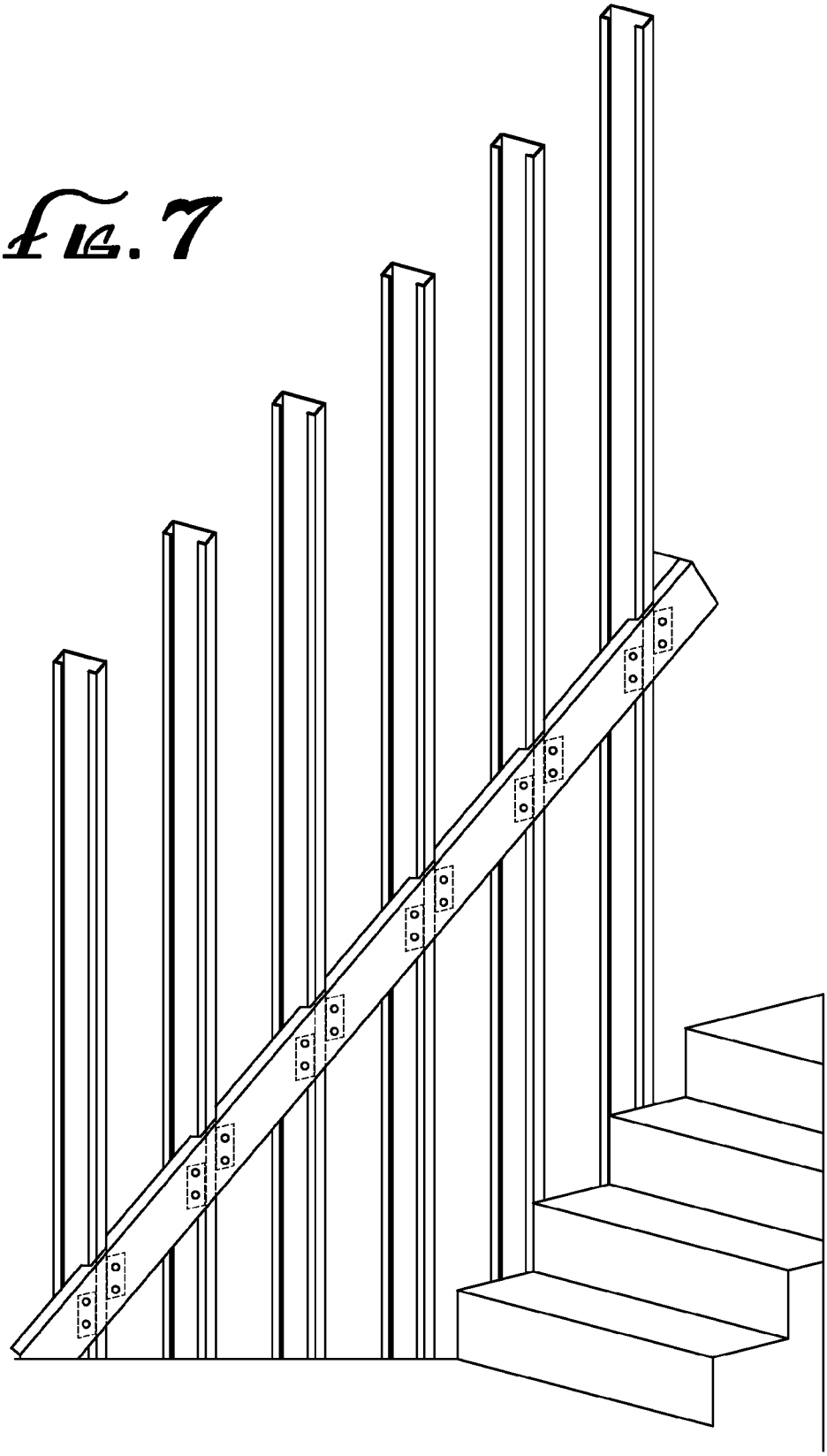
FIG. 7 is a perspective view of an embodiment of the invention, showing a bridge backing member mounted at an angle to the vertical frame members.

As described herein, in a preferred embodiment of the invention, left bracket 40 and right bracket 50 are mounted to a vertical stud 10 such that left bracket 40 and right bracket 50 are on substantially the same elevation, as shown in FIG. 1. However, referring to FIG. 7, which shows another embodiment of the invention, left bracket 40 and right bracket 50 can be mounted to a vertical stud 10 in a stepped configuration. In this configuration, the bridge backing member 20 can be mounted diagonally or at some angle with respect to vertical studs 10.

Figure 9:
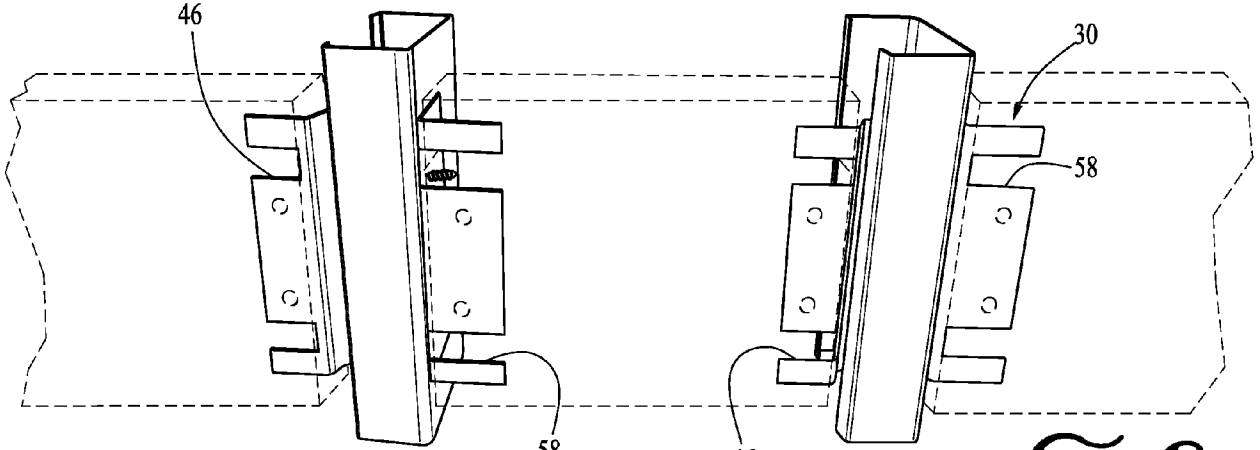
FIG. 9 is a perspective view of an embodiment of the invention, showing a wide bridge backing member mounted to a pair of bracketing systems.

In a preferred embodiment of the invention shown in FIG. 9, bridge backing member 20 is mounted onto bracketing system 30 by mating the web 24 of bridge backing member 20 against either the second left plate 44 of left bracket 40 or second right plate 54 of right bracket 50. When web 24 of bridge backing member 20 is mated against the second left plate 44 of left bracket 40, one flange 22 of bridge backing member 20 sits over a top edge of left bracket 40 and the other flange 22 of bridge backing member 20 sits under a bottom edge of left bracket 40. Similarly, when web 24 of bridge backing member 20 is mated against section 54*b* of second right plate 54 of right bracket 50, one flange 22 of bridge backing member 20 sits over a top edge of right bracket 50 and the other flange 12 of bridge backing member 20 sits under a bottom edge of right bracket 40.

In another embodiment of the invention as shown in FIG. 8, bridge backing member 20 is mounted on bracketing system 30 by inserting flanges 22 of bridge backing member 20 into notches 46 in second left plate 44 of left bracket 40 and into notches 58 in second right plate 54 of right bracket 50.

In this way, left bracket 40 and right bracket 50 can accommodate bridge backing members 20 having webs of different widths. Bridge backing members 20 of varying widths can be mounted to left bracket 40 and right bracket 50 by use of the notches 46 and 58. It would be appreciated by one of ordinary skill in the art that a bridge backing member 20 having a wide web is not only structurally stronger, having a greater load capacity, it will allow the attachment means 70 to be spread out with the result that the mounting of the assembly will be more secure.

When the brackets 40, 50 are screwed to the stud 10, the adhesive material 60 can be pulled off The bridge backing member 20 can then be mounted to the face of the second plates 44, 54 of the respective brackets 40, 50 such that the web 24 of bridge backing member 20 is flush with the flange 12 of the stud 10.

Because of the bridge backing member 20 can be movably positioned on the brackets 40, 50, the bridge backing member 20 can be adjusted to fit between the studs 10 regardless of any variation in the spacing of the studs 10. This obviates the need to cut each stock bridge backing member 20 to fit between variably spaced studs 10. This also obviates the need to cut each stock bridge backing member 20 to create end tabs for mounting with the studs 10.

Figure 10:
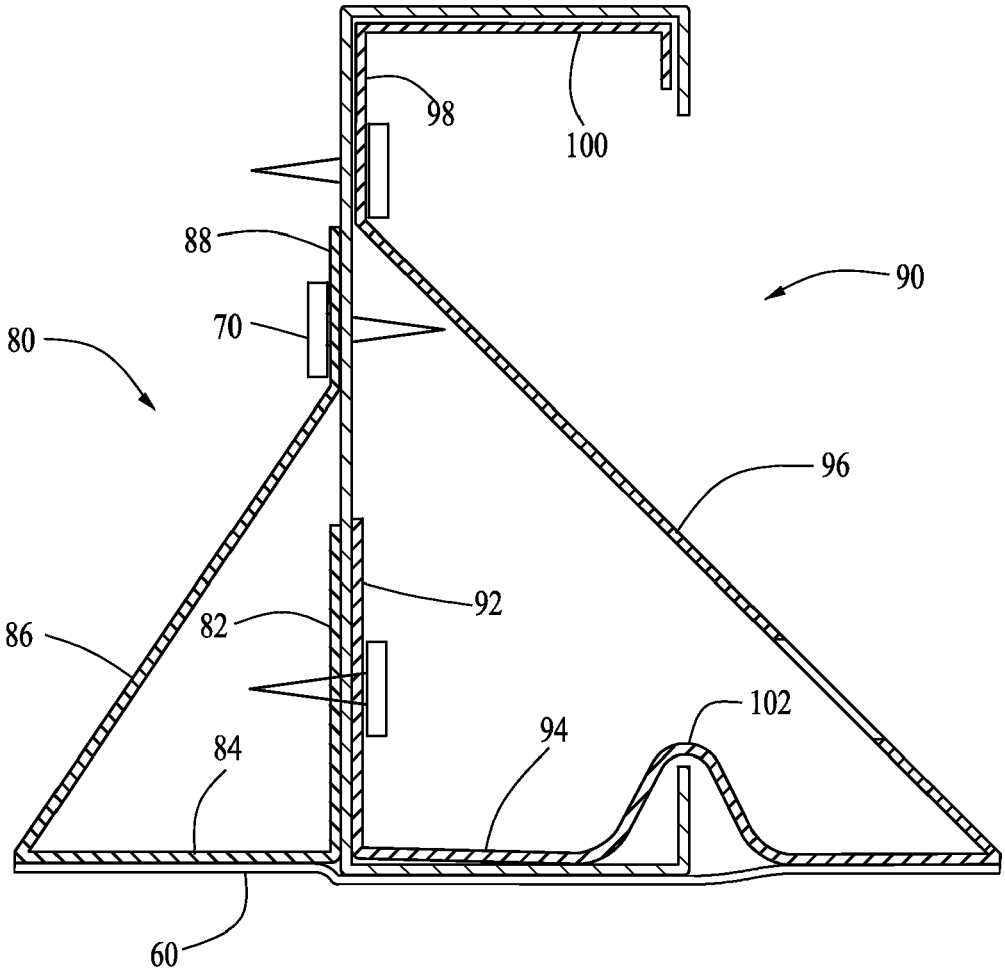
FIG. 10 is a sectional view of an embodiment of the invention.

Another embodiment of the invention is shown in FIG. 10. The bracketing system 30 shown in FIG. 10 is comprised of a left bracket 80 and right bracket 90 connected by adhesive material 60. Again, the "left" and "right" designations are for ease of reference only and are not meant to limit the orientation of the respective brackets.

Left bracket 80 has a first left plate 82 joined at a right angle to a second left plate 84. The second left plate 84 is joined to a third left plate 86, which in a preferred embodiment lies at approximately 45.degree. to second left plate 84, though other angles would work as well. In turn, third left plate 86 is joined at approximately a 135.degree. angle to fourth left plate 88. As shown in FIG. 10, first left plate 82 and fourth left plate 88 are substantially coplanar. The angled third left plate 86 provides additional strength and stability for applications requiring additional load capacity.

Similarly, right bracket 90 has a first right plate 92 joined at a right angle to an elongated second right plate 94. The second right plate 94 is joined to a third right plate 96, which in a preferred embodiment lies at approximately 45.degree. to second right plate 94, though other angles would work as well. In turn, third right plate 96 is joined at approximately a 135.degree. angle to fourth right plate 98. The first right plate 92 is substantially coplanar with fourth right plate 98, with angled right plate 98 providing additional strength and stability for applications requiring additional load capacity.

In an embodiment of the invention, fourth right plate 98 is joined at a right angle to a fifth right plate 100. The fifth right plate 100, parallel to second right plate 94, had a width less than the width of flange 12 of stud 10, such that fifth right plate 100 can fit between web 14 and lip 13. Further, the second right plate 94 has a groove 102 therein that runs substantially along its length and parallel to first right plate 92, dividing second right plate 94 into two sections, 94*a* and 94*b*.

Left bracket 80 is connected to right bracket 90 by adhesive material 60 that attaches to the sides of second left plate 84 and second right plate 94, such that in a closed configuration second left plate 84 and second right plate 94 are substantially coplanar as shown in FIG. 10.

Further referring to FIG. 10, in order to mount this embodiment of bracketing system 30 on vertical stud 10, left bracket 80 is placed on vertical stud 10 with first left plate 82 and fourth left plate 88 mating with first surface 14*a* of web 14 of vertical stud 10. To facilitate assembly of bracketing system 30 on vertical stud 10, adhesive material 60 can be applied to a flange 12 of vertical stud 10 to hold bracketing system 30 in place while left bracket 80 and right bracket 90 are secured to vertical stud 10. The right bracket 90 is wrapped around flange 12 of vertical stud 10, such that first right plate 92 and fourth right plate 98 mate with second surface 14*b* of web 14 of vertical stud 10. In this configuration, first left plate 82 and first right plate 92 sandwich web 14 of vertical stud 10, and second left plate 84 is substantially coplanar with second right plate 94 as shown in FIG. 10. An attachment means 70 is passed through an aperture (not shown) in third left plate 86 to secure first left plate 82 to stud 10. From the opposite side, an attachment means 70 is passed through an aperture in third right plate 96 to secure first right plate 92 to stud 10. Additionally, attachment means 70 are also applied to fourth left plate 88 and fourth right plate 98 to secure left bracket 80 and right bracket 90 to stud 10.

Once left bracket 80 and right bracket 90 are secured to stud 10, a bridge backing member 20 can be mounted to bracketing system 30 as described above. Attachment means 70 is used to fasten bridge backing member 20 on bracketing system 30.

I claim:

1. A bracket assembly for adjustably connecting frames in a building construction assembly, wherein said building construction assembly comprises a vertical stud having a web with at least one flange, said bracket assembly comprising:

a first bracket;

a second bracket;

a removable adhesive sheet connecting said first bracket and second bracket;

wherein said adhesive sheet removably attaches to said at least one flange during installation such that said first and second brackets are aligned on opposing sides of said web and secured to said vertical stud by said adhesive sheet during installation; and said first bracket connecting to a horizontal frame member; whereby said adhesive sheet is capable of being removed after installation is complete.

2. The bracket assembly of claim 1, wherein said first bracket is L-shaped.

3. The bracket assembly of claim 1, wherein said second bracket is L-shaped.

* * * * *